US005081761A

United States Patent [19]

Rinehart et al.

[11] Patent Number: 5,081,761

[45] Date of Patent: Jan. 21, 1992

[54] DOUBLE WALL STEEL TANK

[76] Inventors: Ronald K. Rinehart, 175 Silberhorn Dr., Folsom, Calif. 95630; Chris Johnson, P.O. Box 4927, Arcata, Calif. 95521

[21] Appl. No.: 628,645

[22] Filed: Dec. 12, 1990

Related U.S. Application Data

[63] Continuation-in-part of Ser. No. 510,018, Apr. 17, 1990, abandoned.

[51] Int. Cl.[5] ..... B21D 39/03

[52] U.S. Cl. ..... 29/428; 220/453; 220/444

[58] Field of Search ..... 220/453, 444; 29/428

[56] References Cited

U.S. PATENT DOCUMENTS

| | | | |
|---|---|---|---|
| 3,942,331 | 3/1976 | Newman, Jr. et al. | 220/444 |
| 4,098,426 | 7/1978 | Gerhard | 220/444 |
| 4,100,860 | 7/1978 | Gablin et al. | 220/444 |

*Primary Examiner*—Joseph Man-Fu Moy
*Attorney, Agent, or Firm*—David B. Harrison; Janet K. Castaneda

[57] ABSTRACT

A double wall, light-weight tank construction for the storage of flammable liquids is formed from two conventional steel tanks having flame proof, curable cementitious insulative material between the walls. Spacers preformed preferably of the same cementitious material are glued about the exterior surface of a conventional inner tank having ports. An exterior tank is formed with one end cover being detachable. Apertures are cut in the exterior tank to align with the ports of the inner tank when it is in its final nested position within the exterior tank. Stoppers and vents are placed in a sidewall of the exterior tank. Both tanks are oriented vertically, and the interior tank is then lowered into the exterior tank with concentric alignment provided by the spacers. Nipples are then attached to the ports, and rings are placed over the nipples and welded to the nipples and the exterior tank. The detached end cover is welded to the exterior tank. The assembled tanks are placed horizontally or may remain vertically aligned. Mixed cementitious insulating material in plastic-phase is then pumped upwardly via the sidewall or the bottom stopper to fill the space between the tanks in a single application. The cementitious material is then cured, excess moisture is drained away, and the stoppers and vents are sealed to complete the tank construction.

12 Claims, 3 Drawing Sheets

DOUBLE WALL STEEL TANK

RELATED APPLICATION

This patent application is a continuation-in-part of U.S. patent application Ser. No. 07/510,018, filed on Apr. 17, 1990, now abandoned, the disclosure of which is hereby incorporated by reference.

FIELD OF THE INVENTION

The double walled steel tank of the present invention is for the safe containment and storage of liquids. More particularly, the invention is particularly applicable for the above ground containment of fuels and other corrosive or flammable liquid materials.

BACKGROUND OF THE INVENTION

Safe storage of flammable, corrosive and toxic liquids (hereinafter "dangerous liquids") has become a topic of vital importance to an environmentally concerned public and to the government in the face of increasingly frequent reports of contamination from leaking storage tanks and toxic spills.

Underground storage tanks have been widely used for storage of dangerous liquids across a broad range of many industries. This widespread prior use appears to be premised upon a rationale that such tanks are safer. The earth is frequently viewed as providing a natural containment vessel for the tank, and actually provides some protection against interference from the surface environment and from natural and manmade occurrences and activities.

Single walled underground storage tanks for gasoline and other petroleum products were typically formed of coated steel. As such tanks aged and/or corroded, or were exposed to vibration or seismic occurrences, susceptibility to leakage increased. Small leaks were not originally given much concern. However, with increasing concern for the environment and detection of pollution of ground water from leaking tanks, public concern has increased. In modern times, older tanks are routinely excavated and replaced at considerable cost and with down time of the activity making use of the storage tank being replaced.

One known advantage of an above-ground storage tank for dangerous liquids and the like is that it may be readily inspected visually for any leaks, an advantage not available to underground tanks. However, much greater care must be given to the design and construction of above-ground tanks to be sure that susceptibility to leakage is minimized. Double walled tanks have been proposed to solve leakage problems. In a double walled tank, an inner tank provides a primary containment vessel for the dangerous liquid. An outer, continuous tank provides secondary containment against leakage and also provides an insulation barrier against ambient external interferences. It was also feasible to place sensors in the space between the walls of the outer and inner tanks to monitor for leaks. As experience with double walled tanks grew, it became apparent that such tanks also were susceptible to leakage.

Leakage was found to be caused by cracks or tank ruptures produced by a number of factors, such as unequal weight distribution of the stored liquids, unequal stress distribution throughout the tanks because of construction methods, seismic and thermal forces acting upon the tanks, weathering and corrosion, and combinations of the above listed factors.

Various construction materials and methods have been employed to solve the problem of leakage in double walled storage tanks. Such materials and methods are frequently required to meet government regulations regarding the storage of flammable materials; and, Underwriters Laboratory, Inc. approval is also frequently required by governmental regulatory agencies.

Reinforced concrete is commonly employed in the construction of double walled storage tanks of various shapes and configurations. Typical prior art methods of construction involved forming an outer tank or containment vessel of concrete by pouring or placing plastic-phase concrete around the inner tank which acted as a form. Steel reinforcement material was placed outside of the inner tank and typically connected thereto. The concrete was then applied to complete the double walled tank. A method for forming a double walled storage tank for dangerous liquids out of preformed modules is described in U.S. Pat. No. 3,404,500 to Akita et al. It has proved difficult to ensure that the reinforced concrete, which is vulnerable to temperature changes, will be crack resistant. Concrete absorbs heat which causes expansion of the stored liquid within the tank and thereby increases stress upon the tank. In addition, construction techniques may produce air pockets in the concrete and/or the insulation substance used between the tanks; and, it is difficult to assure dissemination of the concrete to all recesses of the space between the double tanks. In addition to such distribution and curing problems, double walled tanks preformed of reinforced concrete are very heavy and cumbersome to transport and install at the use site. The increased weight also contributes to internal stresses within the tank structure and may lead to cracking and failures of the concrete outer containment tank.

Contemporary above-ground double walled tanks for storing dangerous liquids are typically rectangular. These tanks are constructed with steel inner tanks encased in six-inch thick steel reinforced concrete outer tanks. Such tank structures weigh approximately 18,000 pounds and are subject to considerable internal stress forces at various locations, such as the junction of the base and the side walls. Various methods are used to decrease leakage in such tanks, such as coating the inner tank with fluid-tight barrier substances, using a compartmentalized inner tank which attempts to confine leakage to the affected compartment of the inner tank, using cylindrical tanks, wrapping the inner tank with plastic materials to provide an additional barrier, and reinforcing the areas subject to the most stress.

Two prior art double tank construction methods are discussed in the Kotcharian U.S. Pat. No. 4,513,550 and the Lindquist et al. U.S. Pat. No. 4,826,644. The Kotoharian method is drawn to a rectangular tank constructed by building an outer pre-stressed concrete tank, coating the inner walls of the outer tank with a fluid-barrier substance, mounting a pre-coated steel inner tank within the outer tank, and filling the space between the two tanks with stacked blocks of polystyrene insulation in order to accommodate the severe thermal gradient arising from storage of liquid energy gas at extremely low temperature.

The Lindquist method calls for construction of a rectangular storage tank by gluing polystyrene panels to the outer surface of an inner steel tank. A polystyrene liner is then placed between a form defining the contour of an outer tank and the polystyrene panels, and the outer tank is formed of plastic-phase concrete emplaced between the form and the inner tank.

Additional insulating materials have been used in tanks for transporting hazardous materials and for storing cryogenic materials. The Gablin et al. U.S. Pat. No. 4,100,860 discusses a hinged or otherwise openable transportation tank with an outer shell constructed from a ductile metal. Polyurethane foam is used as insulation to permit safe transportation at maximum temperatures of approximately 100 degrees Fahrenheit. The Gerhard U.S. Pat. No. 4,098,426 also discusses the use of polyurethane foam material for insulation in transportation tanks. Polyurethane foam insulation does not provide sufficient fire protection for tanks used to store flammable liquids.

The Newman, Jr. et al. U.S. Pat. No. 3,942,331 discusses a cryogenic tank having a deformable inner tank and synthetic, resinous cellular insulation to maintain the very low temperature of the storage material. A conduit is emplaced in the insulation to maintain a subatmospheric pressure between the inner and the outer square tank.

SUMMARY OF THE INVENTION WITH OBJECTS

A general object of the present invention is to provide a double wall storage tank for the containment of liquids which is constructed using a method that overcomes the limitations and drawbacks of the prior art.

A specific object of the present invention is to provide a method of construction for a generally cylindrical double wall tank for the above ground safe storage of dangerous liquids, the cylindrical configuration enabling more equal weight and stress distribution within the tank construction.

Another specific object of the present invention is to provide a method of construction that produces a lightweight double wall tank that enables the tank to be more easily transported and installed for use.

One more specific object of the present invention is to provide a method of constructing a double wall storage tank from nesting together in a substantially coaxial alignment two conventional cylindrical steel tanks and emplacing and curing a cementitious, curable insulating material, such as Pyrocrete TM insulating material, between the nested tanks to form the double wall tank construction.

Still another specific object of the present invention is to provide a double walled steel tank having a cured cementitious material sealed between the tanks, the cementitious material providing at least two plus hours of fire protection for the double walled tank.

Yet another specific object of the present invention is to provide a method of construction of a double wall steel tank that overcomes the structural drawbacks associated with the placement, cure, and use of reinforced concrete as an insulating material.

Yet one more specific object of the present invention is to provide a method of construction of a double wall steel tank that meets generally accepted standards imposed by the industries using such tanks and by governmental regulatory agencies.

One further object of the present invention is to provide a simplified method of construction of a double wall steel tank that permits the convenient nesting and use of conventionally available steel inner and outer tanks, thereby eliminating the need for any special tank fabrication.

Still another object of the present invention is to provide a method of construction of a double wall steel tank that eliminates the need for special tooling to maintain the inner tank in position during the emplacement of the cementitious liner during construction.

In accordance with the present invention, a method for forming a double wall tank construction for the containment of dangerous liquids above the ground includes the following steps:

forming a generally cylindrical inner steel tank having a predetermined outside diameter and at least one inner port for filling and emptying a dangerous liquid to and from the interior storage space of the inner tank;

forming a generally cylindrical exterior steel tank having an inside diameter selected to be larger than the predetermined outside diameter of the inner steel tank and preferably including at least one moisture vent and one outer port for filling and emptying the storage space, the outer port being in alignment with the inner port when the double wall tank construction is completed, the exterior steel tank being formed with one end closure thereof being freely detachable from a cylindrical body thereof, and with another end closure being attached to the cylindrical body;

attaching spacers at spaced apart locations about the exterior of the inner steel tank, the spacers having a thickness dimension slightly less than one half the difference in outside diameter of the inner tank and inside diameter of the outer tank;

aligning the exterior tank in a vertically upright orientation with the detachable closure end being at the top and with the end closure removed;

positioning the inner tank in vertical orientation above the exterior tank and dropping the inner tank downwardly into the exterior tank and orienting the inner tank circumferentially relative to the exterior tank until the inner tank is nested within the exterior tank at a nesting position as controlled by the spacers to be substantially concentric with the exterior tank, and with the inner port aligned with the outer port;

attaching conduit means between the inner port and the outer port;

enclosing the open end of the exterior tank with the closure end therefor;

emplacing a cementitious, curable insulating material into a space formed between the inner and the exterior tanks not occupied by the spacers; and curing the cementitious material;

draining any excess moisture from the filled space between the two tanks; and sealing all pumping inlets and plugging all moisture vent outlets to complete construction of the double wall tank construction.

In one aspect of the present invention, the method includes the further step of attaching a support base structure to the double wall tank construction.

In another aspect of the present invention, the method includes the further step of forming the spacers of the same cementitious, curable insulating material as is emplaced in the space between the exterior and inner tanks.

In yet another aspect of the present invention, the method includes the further step of affixing stoppers to a flanged end of the exterior tank and to a sidewall of the exterior tank.

In yet one more aspect of the present invention, the cementitious material is pumped while the metal tanks are horizontally aligned. For horizontal pumping, at least one clamp is placed around the exterior surface of the exterior tank in order to maintain the spherical shape of the exterior tank during the pumping of the cementitious material into the space between the tanks.

These and other objects, aspects, advantages and features of the present invention will be more fully understood and appreciated upon consideration of the following detailed description of a preferred embodiment, presented in conjunction with the accompanying drawing.

DETAILED DESCRIPTION OF A PREFERRED EMBODIMENT

Figure 1:
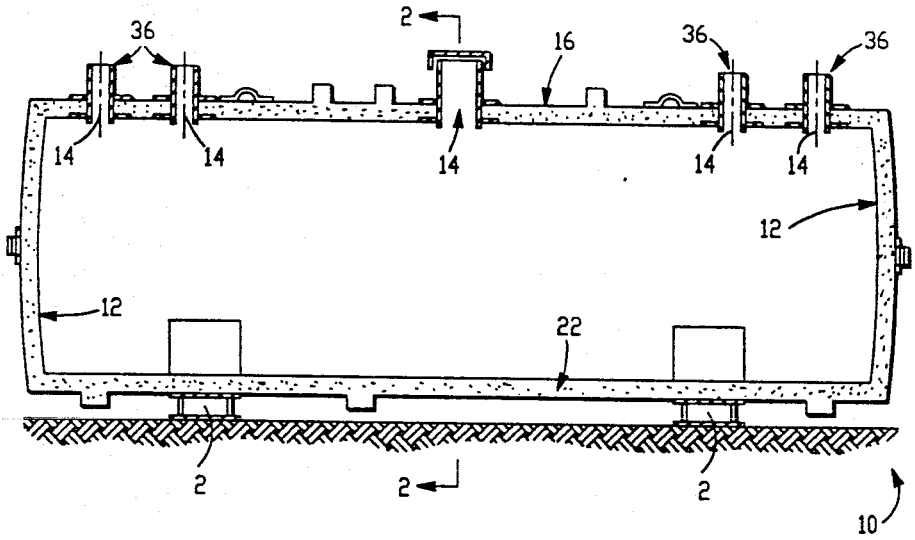
FIG. 1 is side sectional view of the assembled double wall tank of the present invention.
Figure 2:
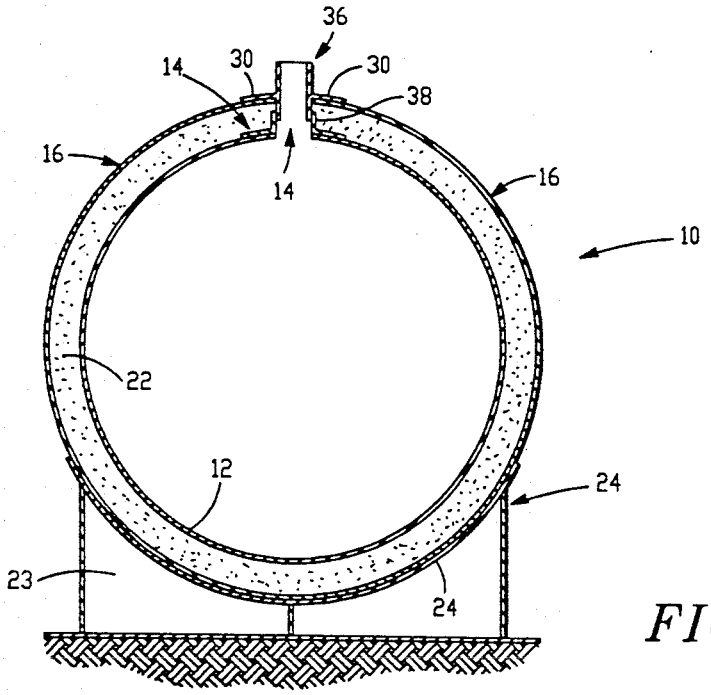
FIG. 2 is a cross sectional view taken along the lines shown as 2 in FIG. 1.

Referring to the drawings, FIGS. 1 and 2 show an assembled double wall tank construction 10 incorporating the principles of the present invention. The double wall tank construction 10 includes an inner tank 12 and an outer tank 16. The inner tank 12 is an Underwriters Laboratory, Inc. approved, approximately 950 gallon, generally cylindrical tank formed of 3/16" or ⅛" thick steel sheet material for example. With an approximately 950 gallon storage capacity, typical dimensions for the inner tank 12 are approximately 12 feet in length and 4 feet in diameter. The method of constructing the double wall tank 10 of the present invention is applicable to a wide range of tank sizes, dimensions, and metal/alloys. One or more ports 14 are provided in the inner tank 12 to enable liquids, such as dangerous liquids, to flow in and out of the storage area.

The exterior tank 16 is also preferably a conventional Underwriter Laboratory, Inc. approved 3/16" or ⅛", circular steel tank, for example. The inside diameter of the exterior tank 16 is chosen to be approximately 2 ¼" greater than the outside diameter of the inner tank 12, and exterior tank 16 is approximately 2" longer than inner tank 12. The exterior tank 16 is initially formed or selected to be without any ports. The exterior tank 16 also is formed with at least one removable end cover 18, shown in FIG. 3, the other end cover 20 being attached conventionally as by welding to the adjacent end region of the generally cylindrical body of the tank 16. Pumping inlets 11 are provided in the bottom of the exterior tank 16. Moisture vent outlets 17 are provided in the top of the tank 16.

A space between the inside wall surface of the exterior tank 16 and the outside wall surface of the concentrically aligned inner tank 12 is filled, as by pumping under pressure, with suitable plastic-phase, curable cementitious insulating material 22 in fluid phase, such as catalyzed magnesium oxychloride supplied in crystal and powder form and then mixed with water. One suitable product is sold under the brand name Pyrocrete TM, Carboline, Fireproofing Products Division, RPM Company, 350 Hanley Industrial Court, St. Louis, MO 63144-1599. Pyrocrete is a fire resistant substance rated by Underwriters Laboratories, Inc. to meet ASTM-E-119 specifications when applied to the exterior surface of a structure to a specified thickness. When emplaced and cured, Pyrocrete forms a durable, non-flammable, non-friable solid substance that is one-third the weight of conventional reinforced concrete. The physical properties of Pyrocrete applied to external surfaces include a hardness of 65–70, compression strength of 2000 psi, coefficient of thermal expansion of 5.1 times 10–6 inch/inch/degree F, average flexural strength of 1000 psi, maximum strain of 0.0041 inches/inch, and shrinkage of 0.5%.

For use, the dried Pyrocrete may be mixed with water in a conventional mortar mixer and has a two hour pot life at 24 degrees C before setup. The material may be sprayed or pumped in a monolithic application. Curing takes 24 hours at 21 degrees C, or may be accomplished at 150 degrees C. Cured Pyrocrete retains water which, during a fire, dissipates absorbed heat as it slowly evaporates from the Pyrocrete.

When used as fire proofing material between two sealed tanks in the instant application, rather than as an external coat exposed to the atmosphere, cured Pycrocrete retains a fixed amount of additional moisture. Slow evaporation of the additional moisture during an external fire condition prolongs the fire-proofing function of the resultant tank structure to at least two plus hours, for example.

The assembled double wall storage tank construction 10, as shown in FIGS. 1 and 2, is attached to and supported by a base structure such as a pair of tank rests 23. Each tank rest 23 may be formed as a saddle and constructed of 3/16" steel. A support surface 24 of the rest is designed to match the undeformed outer contour of the outer tank 16 so that its weight is evenly distributed along the surface 24, thereby minimizing stress points on the tank assembly 10 and providing further structural integrity thereto. While the tank construction 10 shown in FIGS. 1 and 2 is shown installed with its major axis aligned horizontally, a suitable base structure may be provided for mounting in other orientations, such as vertically, if desired.

As formed, the double wall storage tank construction 10 weighs approximately 3000 pounds and is therefore readily transportable by conventional road truck, and off-loaded and installed by reasonably small cranes, forklifts, or backhoes at the worksite.

Figures 3A, 3B, 3C, 3D, 3E, 3F, 4D:
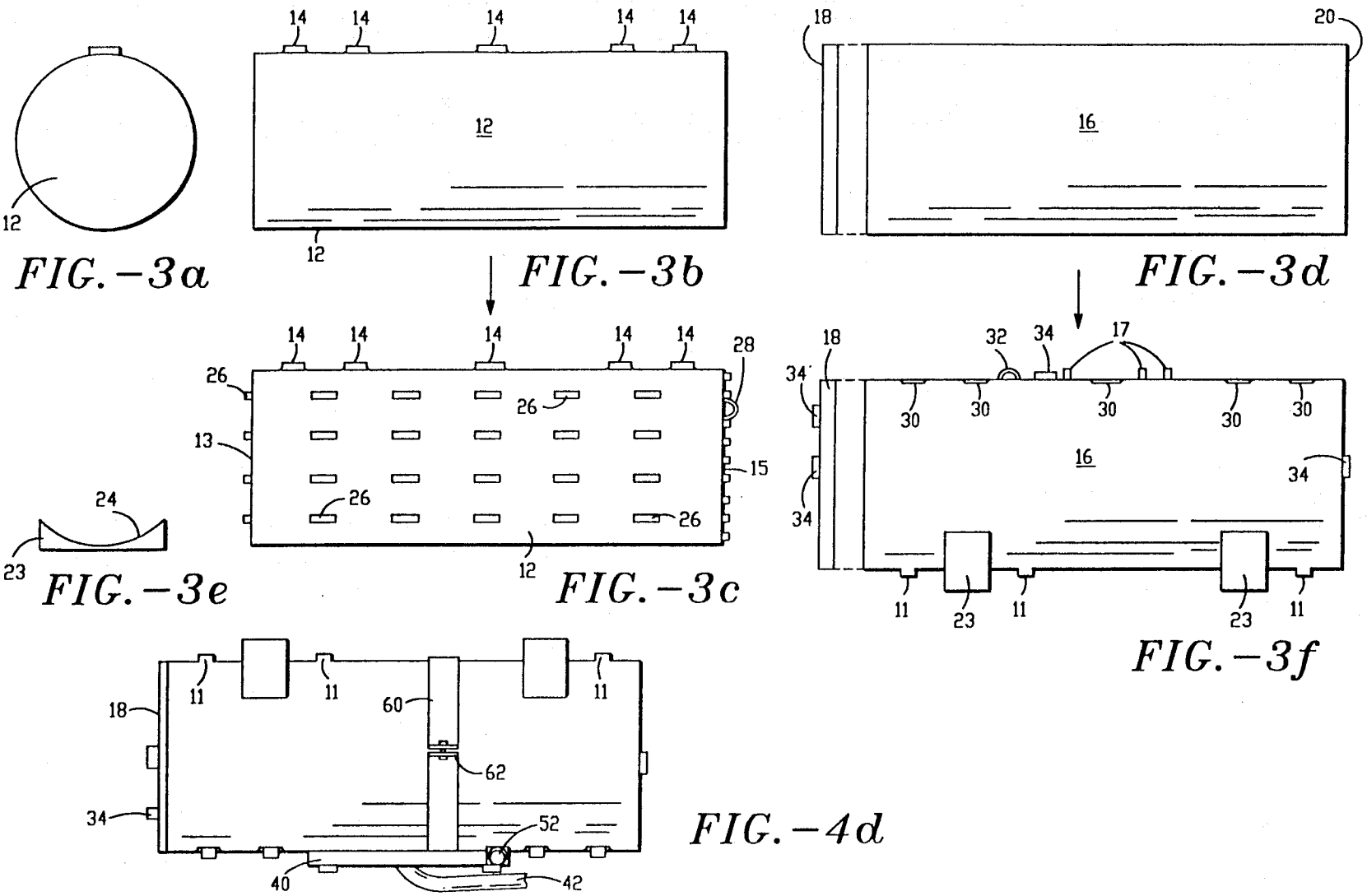
FIGS. 3*a*, 3*b* and 3*c* illustrate three views of an inner tank undergoing preparation steps for assembly into the FIGS. 1 and 2 tank construction of the present invention.
FIGS. 3*d*, 3*e* and 3*f* illustrate steps relating to preparation of an exterior tank for assembly into the FIGS. 1 and 2 double wall storage tank construction of the present invention.
FIGS. 4*a*, 4*b*, 4*c*, 4*d* and 4*e* illustrate assembly of the inner tank into the exterior tank and addition of the curable, cementitious insulating material to complete the double wall storage tank construction.

FIGS. 3*a*, 3*b* and 3*c* detail the preparation steps for the inner tank 12, and FIGS. 3*d*, 3*e* and 3*f* detail the preparation of the exterior tank 16. While a single port 14 is feasible for introduction and discharge of liquid from the storage area of the inner tank 14, four cylindrical ports 14 are shown in FIG. 3*b* in order to accommodate loading, unloading, measuring and venting functions. The four ports 14 are formed through the sidewall of the inner tank 12. The ports 14 are reinforced by flanges welded to the sidewall having internal threads for the attachment of standard threaded conduit. Preferably, although not necessarily, the four ports 14 are in longitudinal alignment along the sidewall of the inner tank 12.

The exterior surface of the inner steel tank 12 is then cleaned with a suitable non-residue cleaning agent; and, then a plurality of spacers 26 are affixed in spaced apart relationship about the exterior cylindrical surface of the inner tank 12, as shown in FIG. 3*c*. The spacers or "dobeys" 26 are attached by a suitable epoxy resin or an equivalent adhesive substance. For a 950 gallon tank construction, the spacers 26 are made to be approximately 1" in depth and width and 4" in length. In accordance with an aspect of the invention, the spacers are preformed of the same curable cementitious material 22 as is emplaced throughout the space between the nested tanks 12 and 16 Each spacer 26 is arranged to have its longitudinal axis substantially parallel with the axis of the inner tank 12, as shown in FIG. 3*c*. The spacers 26 are set at 2 foot intervals. The spacers 26 are also glued to the end covers 13 and 15 of the inner tank 12. In an aspect of the invention, additional spacers 26 are added to a sidewall of the interior tank 12, or to one end of the interior tank 12. The spacers 26 function as guides for enabling the inner tank to be concentrically aligned and centered relative to the exterior tank 16. The use of the same cementitious insulating substance having the same inherent properties, e.g. Pyrocrete, for the spacers 26 and for the fire proofing insulating material 22 between the inner tank 12 and the exterior tank 16 guarantees that the spacers and the filler will react similarly to stress and environmental factors, thereby increasing the possibility of maintaining a continuous filler between the two tanks 12 and 16 of the assembled construction 10. There is also no possibility of chemical interaction between the spacers 26 and the filler 22.

Following attachment of the spacers 26, a lifting eye 28 is welded to the end 15 of the inner tank 12 having the greater number of spacers 26. The lifting eye 28 provides a convenient attachment point for lifting the inner tank 12 into a vertical orientation.

The exterior steel tank 16 is formed to be sufficiently larger than the inner tank 12 so that a space of at least approximately 1" exists between the two tanks 12 and 16 when they are in assembled and nested arrangement, as shown in FIGS. 1 and 2, for example. One end cover 18 is not permanently attached to the exterior tank 16, while another end cover 20 is permanently attached.

The location and size of the ports 14 of the inner tank 12 are transferred to the outer tank 16, and cylindrical openings 30 are then made through the exterior tank 16 to be in alignment with the respective positions of the ports 14 on interior tank 12. The openings 30 are cut to be approximately 1" larger in diameter than the nominal diameter of the corresponding ports 14, to provide for some tolerance in the assembly process of the two tanks 12 and 16. A plurality of moisture vents 17, e.g. three or more, are provided in FIG. 1. The vents are formed through the sidewall of the exterior tank 16. The vents 17 are located across the top surface of the exterior tank 16 and are reinforced by flanges. The vents 17 enable vaporized steam to escape from the cementitious material in response to heating by an external fire or other heat source.

If a horizontal mounting arrangement is desired, the exterior tank 16 is then placed onto the contoured concave surface 24 of each of the tank rests 23 shown in FIG. 3*e*. The tank rests 23 are approximately 8" across. Two steel tank rests 23 are preferred and are positioned approximately 2 feet from each end of the exterior tank 16. The tank rests 23 are then secured to the exterior tank 16 along a continuous weld seam. A lifting eye 32 is then attached to the sidewall of the exterior tank 16, and a stopper 34 is then formed through the welded end 20 of the exterior tank 16, or preferably a plurality of stoppers 11 are formed through the sidewall of the exterior tank 16. Two stoppers 34 are formed through the detached, flanged end 18 of the exterior tank 16.

Referring now to FIG. 4*a*–4*e*, final assembly of the inner tank 12 into the exterior tank 16 is shown. Chains or other suitable lifting cables are attached to the lifting eyes 28 and 32 of the inner tank 12 and the exterior tank 14, respectively. The exterior tank 16 is then lifted vertically by a crane or hoist (not shown) and the welded flanged end 20 of the exterior tank 16 is rested upon a suitable support surface. The crane or hoist is then attached to the inner tank 12 and it is lifted into a vertical position directly over the open end of the exterior tank 16. The inner tank 12 is then carefully lowered into the exterior tank 16 and aligned circumferentially with the exterior tank 16 by action of the spacers 26 against the inner sidewall of the exterior tank 16. As the inner tank 12 is lowered into the exterior tank 16, care is taken to be sure that the openings 30 of the outer tank 16 come into correct alignment with the ports 14 as the inner tank reaches its final, fully nested position. The space between the interior tank 12 and the exterior tank 16 is then inspected to ensure circumferential alignment of the two tanks 12 and 16.

Following the inspection for alignment, standard pipe nipples 36 of appropriate sizes to correspond to the diameters of ports 14 are inserted through cylindrical openings 30 and plumbed into the threaded ports 14 using a continuous weld. Welding donut-shaped steel rings 38 are then placed over the pipe nipples 36 and continuously welded to the nipples 36 and to the exterior tank 16, as best shown in FIG. 2. The detached outer end cover 18 may then be welded onto the outer tank 16 with a continuous seam, as is conventional for end closures of such tanks.

Figure 4E:
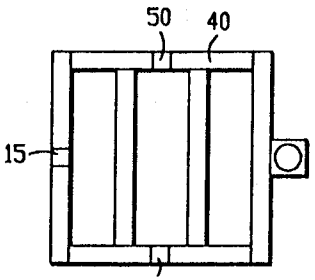
Figure 4C:
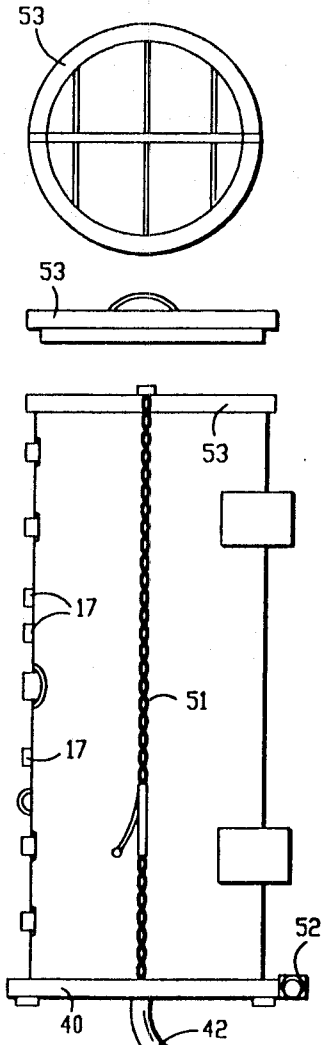
Figure 4B:
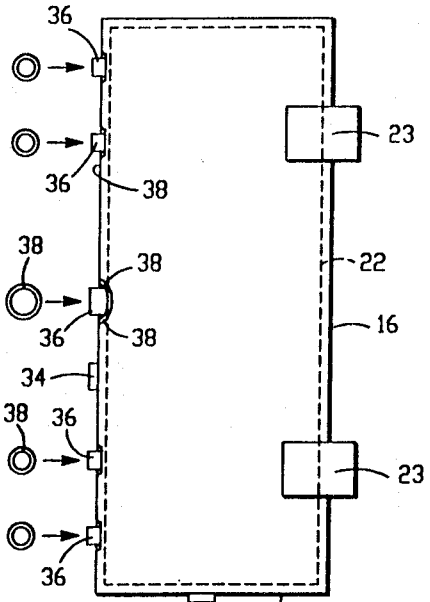
Figure 4A:
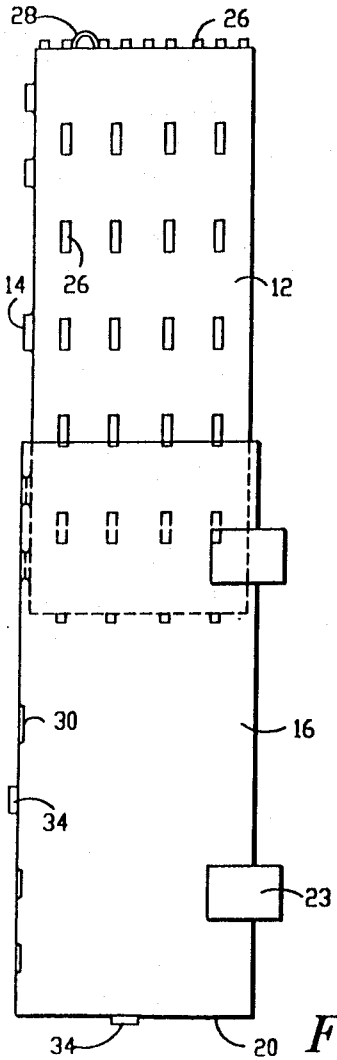

A mortar hose 42 is next plumbed into the stopper 11 or the stopper 34 in the welded end 20 of exterior tank 16. As shown in FIG. 4*c*, the nested tanks are next placed vertically upon a pallet 40, FIG. 4*d*, which may be a vibrating pallet or preferably a pallet to which a vibrator 52 may be easily attached. The pallet 40 defines an open gridwork to allow access to the bottom stopper 34 on the exterior tank 16. The pallet 40 may be constructed from standard 4" by 4" hollow steel tubing and mounted on springs or suitable mounts permitting vibration movement relative to the floor or base. Several two inch holes 50 are placed in the tubing of the pallet 40 to enable a conventional chain 51 to be secured to the pallet 40. The chain 51 may be tightened over an angle-iron weighting grid 53 that is placed on top of the end of the interior tank 12 in order to prevent the interior tank 12 from floating upwardly during filling of the space between the tanks with the cementitious material. In addition, the additional spacers attached to end 18 of the interior tank 12 provide additional surface area to transfer some of the upward forces of the interior tank 12 to the weighted outer end cover 18. The two stoppers 34 in the upper end closure 18 are left open to provide exhaust gas venting during the filling process.

Referring now to FIG. 4*d*, the nested tanks are shown being filled while in a preferred, horizontal orientation.

Figure 5A:
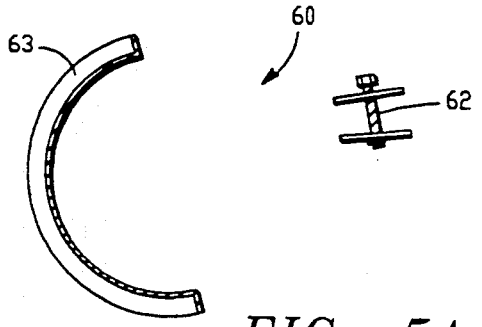
FIGS. 5*a* and 5*b* illustrate the clamping mechanism used in the horizontal method of tank assembly.
Figure 5B:
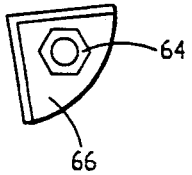

The nested tanks of FIG. 4 are lowered and placed horizontally on the pallet 40. The tanks are preferably filled through the bottom inlets 11, or through the sidewall stopper 34. The additional spacers 26 added to the sidewall of the interior tank 12 provide additional surface area to transfer some of the upward forces of the interior tank to the outer tank 16. These forces arise as the cementitious insulating material is pumped upwardly through the mortar hose 42 and stopper 34 thereby causing the inner tank 12 to tend to float upwardly which causes the diameter of the middle area of the external tank to expand. A suitable clamping device 60, such as angle iron is also placed around the exterior tank 16 and in close proximity to the welded port 14 in order to maintain the cylindrical dimension of the external tank 16, as shown in FIG. 4*d*. As shown in FIG. 5*a*, the clamping device is two pieces of 2 ½ inch angle iron which have been rolled to the exact diameter of the outer tank 16. The two pieces together encircle the tank and are attached together with a bolt 62, such as a speed bolt, which may be secured within a nut 64 that is welded onto an attachment plate 66. Conventional chain retaining procedures of the prior art are thereby rendered 0 unnecessary when the tanks are positioned horizontally prior to filling.

The cementitious insulating material 22, such as Pyrocrete, is mixed with water, for example, according to its mixing specifications in a conventional concrete or mortar mixer (not shown). Referring now to FIGS. 4*c* and 4*d*, while the base 40 is being intermittently vibrated, the mixed insulating material 22, now in a viscous, plastic state, is then pumped by a conventional mortar pump (not shown) through the hose 42 upwardly into all of the space between the interior tank 12 and the exterior tank 16. Pumping the insulation material 22 upwardly and filling the space from the bottom eliminates air pockets and enables the dissemination of the material 22 into all of the nooks and crannies presented by the spacers 26 as well as all of the major spaces therebetween. Intermittent vibration is applied during the pumping operation further to eliminate formation of any air bubbles or pockets. The vibrator 52 may be directly attached to the hose 42 thereby providing direct vibration at the point of entry of the Pyrocrete into the space 22.

After the cementitious material 22 is emplaced in the space between the tanks 12 and 16, it is permitted to cure according to its cure characteristics. Pyrocrete remains in a workable plastic phase for about two hours after mixing with moisture, and it is allowed to cure for 48 hours at 150 degrees C. Curing may also be accomplished by introducing heated steam into the interior of the nested tanks. The insulating properties of the Pyrocrete material layer cause the heat from the steam to be transferred to the Pyrocrete to aid in the curing process.

Following curing, the inlets 11 are opened to release excess water left over from the cured cementitious material. The pumping inlets 11 are next plugged with suitable threaded plugs coated with a sealing substance, such as pipe dope. The plugs are tightened to provide secondary containment. The moisture vent outlets 17 are plugged with a heat yielding plug, such as a silicon material or plastic material In the event of a fire, the plugging material in the vents 17 softens and the steam pressure created by the vaporized moisture in the Pyrocrete will push the plug substance out of the vents 17, thereby enabling the heat carrying steam to be released from between the tanks. The tank construction and venting feature extend the effective heat resistance of the tank by a considerable time period, such as two hours.

All rough edges on the double wall tank construction 10 are then removed, and the outer surface of exterior tank 16 is then cleaned with steel wool, and painted with a suitable weather protective paint. The construction 10 is then tested for structural integrity and made ready for shipment and use.

Although a preferred embodiment of the present invention has been disclosed, it is contemplated that various modifications of the invention will become apparent to those skilled in the art after having read the foregoing description. For example, conventional steel pipe may be used to create the interior and the exterior tanks. Convention arrangements for weighting the interior tank prior to introduction of the Pyrocrete may be employed if desired. Various sizes, shapes, numbers, and arrangements of the Pyrocrete spacers may be used. The Pyrocrete may be introduced in several stages if desired. The number and positions of the vents and pumping inlets may be varied, and the clamping device may be made from other materials and secured to the exterior tank by other suitable devices. In addition, the moisture vents may include a metal one-way pressure valve instead of the plugging material. Accordingly it is intended that the description be interpreted to cover all alterations and modification there of which fall within the true spirit and scope of the invention.

INDUSTRIAL APPLICABILITY

The double wall storage tanks of the present invention may be used for the above ground storage of dangerous liquids, including for example flammable liquids including petroleum products such as gasoline, diesel fuel, and waste oil, and other toxic liquid materials and corrosive liquid materials.

What is claimed is:

1. A method for manufacturing a double wall tank of the type for storing liquids and having an exterior tank, a smaller inner tank concentrically nested within the exterior tank, there being a space defined between the exterior tank and the inner tank occupied by a cured cementitious insulating material, the method comprising the steps of:

forming a generally cylindrical inner steel tank having a predetermined outside diameter and at least one inner port for filling and emptying a dangerous liquid to and from the interior storage space of the inner tank;

forming a generally cylindrical exterior steel tank having an inside diameter selected to be larger than the predetermined outside diameter of the inner steel tank and having at least one outer port for filling and emptying the storage space, the outer port being in alignment with the inner port when the double wall tank construction is completed, the exterior steel tank being formed with one end closure thereof being freely detachable from a cylindrical body thereof, and with another end closure being attached to the cylindrical body;

attaching spacers at spaced apart locations about the exterior of the inner steel tank, the spacers having a thickness dimension slightly less than one half the difference in outside diameter of the inner tank and inside diameter of the outer tank;

aligning the exterior tank in a vertically upright orientation with the detachable closure end being at the top and with the end closure removed;

positioning the inner tank in vertical orientation above the exterior tank and dropping the inner tank downwardly into the exterior tank and orienting the inner tank circumferentially relative to the exterior tank until the inner tank is nested within the exterior tank at a nesting position as controlled by the spacers to be substantially concentric with the exterior tank, and with the inner port aligned with the outer port;

attaching conduit means between the inner port and the outer port;

enclosing the open end of the exterior tank with the closure end therefor;

emplacing a cementitious, curable insulating material formed between the inner and the exterior tanks not occupied by the spacers;

curing the cementitious material;

draining any excess moisture from the cured cementitious material;

enclosing the space having the cured cementitious material to complete construction of the double wall tank construction.

2. The method set forth in claim 1 comprising the further step of attaching a support base structure to the double wall tank construction.

3. The method set forth in claim 1 comprising the further step of forming the spacers of the same cementitious, curable insulating material as is emplaced in the space between the exterior and inner tanks.

4. The method set forth in claim 1 comprising the further step of forming at least one stopper in a sidewall of the cylindrical body of the exterior tank.

5. The method set forth in claim 1 comprising the further step of forming at least one moisture vent means in a sidewall of the cylindrical body of the exterior tank.

6. The method set forth in claim 5 comprising the further step of plugging the vent means with a heat-yielding plug.

7. The method set forth in claim 4 comprising the further step of sealing the stopper after draining the excess moisture.

8. The method set forth in claim 1 comprising the further step of applying vibration to the nested inner and exterior tanks as the cementitious material is being emplaced in the space therebetween.

9. The method set forth in claim 1 wherein the cementitious, curable insulating material comprises in solid phase prior to mixture with moisture and emplacement a crystal and powder formulation of catalyzed magnesium oxychloride.

10. The method set forth in claim 1 comprising the further step of forming at least one stopper at a flanged end of the exterior tank and at least one stopper at a sidewall of the exterior tank.

11. The method set forth in claim 4 comprising the further step of lowering the nested tanks into a horizontal alignment prior to emplacing the cementitious insulating material into the space between the inner and the exterior tanks.

12. The method set forth in claim 11 comprising the further step of emplacing a clamp means on the exterior tank prior to emplacing the cementitious insulating material into the space between the inner and the exterior tanks.

* * * * *